US005794447A

United States Patent [19]

Nicodemus

[11] Patent Number: 5,794,447

[45] Date of Patent: Aug. 18, 1998

[54] RANKINE CYCLE BOILER FEED VIA HYDROKINETIC AMPLIFIER

[75] Inventor: Mark Nicodemus, LeRoy, N.Y.

[73] Assignee: Helios Research Corporation, Mumford, N.Y.

[21] Appl. No.: 627,243

[22] Filed: Apr. 1, 1996

[51] Int. Cl.[6] ..... F01K 9/00; F04F 5/00

[52] U.S. Cl. ..... 60/654; 417/54; 417/197

[58] Field of Search ..... 60/654; 417/54, 417/187, 197

[56] References Cited

U.S. PATENT DOCUMENTS

| | | |
|---|---|---|
| 3,314,236 | 4/1967 | Zanoni . |
| 3,686,867 | 8/1972 | Hull . |
| 4,051,680 | 10/1977 | Hall . |
| 4,569,635 | 2/1986 | Nicodemus . |
| 4,673,335 | 6/1987 | Nicodemus . |
| 4,781,537 | 11/1988 | Nicodemus et al. . |

FOREIGN PATENT DOCUMENTS

| | | |
|---|---|---|
| 0514914 | 11/1992 | European Pat. Off. . |
| WO9110832 | 7/1991 | WIPO . |

*Primary Examiner*—Noah P. Kamen

*Attorney, Agent, or Firm*—Eugene Stephens & Associates

[57] ABSTRACT

A hydrokinetic amplifier can pump and heat condensate returned to a boiler in a Rankine cycle system by receiving vapors at different pressures that are directed into merger with a condensate stream that is accelerated through merging regions. By properly selecting parameters for successive stages of a hydrokinetic amplifier and for the liquid and vapor inputs to a hydrokinetic amplifier, the condensate return can be pressurized to boiler pressure and heated close to the boiling point at boiler pressure.

44 Claims, 3 Drawing Sheets

RANKINE CYCLE BOILER FEED VIA HYDROKINETIC AMPLIFIER

TECHNICAL FIELD

This invention involves a Rankine cycle system using a hydrokinetic amplifier to combine vapor and condensate so that the condensate is warmed and pressurized for return to a boiler.

BACKGROUND

Rankine cycle systems condense a working vapor and return a condensate to a boiler for revaporization. While the condensate is pumped back to the boiler, it is routed through several heat exchangers where its temperature is successively raised by vapor drawn from different regions of a turbine. This requires considerable mechanical pumping work and the expense of a series of cumbersome heat exchangers.

Hydrokinetic amplifiers, which combine vapor and liquid to produce a warmed and increased pressure output, have been suggested for such condensate return. They have an inherent advantage for this, because they can provide considerable pumping work while warming a condensate being pumped. U.S. Pat. No. 4,569,635 suggested staging hydrokinetic amplifiers in series, with an upstream hydrokinetic amplifier powered by a lower pressure vapor and one or more downstream hydrokinetic amplifiers powered by successively higher pressure vapor so that the final output of such hydrokinetic amplifiers exceeds boiler pressure and warms the condensate return to as high a temperature as possible. Another U.S. Pat. No. 4,781,537 suggested directing preheated condensate liquid through a secondary inlet of a hydrokinetic amplifier to merge with condensate accelerated through the R area (minimum cross-sectional area) so as to increase and warm the output flow rate.

I have improved upon both of these approaches and have devised a better way of arranging a hydrokinetic amplifier in a Rankine cycle system for effectively and efficiently returning condensate to a boiler and for preheating the returned condensate, which is desirable for optimum efficiency. My arrangement aims at eliminating the need for successive heat exchangers for preheating boiler feed return and also aims at significantly reducing the mechanical work expended in pumping condensate up to boiler pressure.

A hydrokinetic amplifier as arranged in my Rankine cycle boiler feed system receives as inputs vapors from two or more different locations. There is precedent in the hydrokinetic amplifier art for inputting two different vapors into a hydrokinetic amplifier. U.S. Pat. No. 4,673,335 suggests admitting an additional gas or vapor into the primary mixing chamber of a hydrokinetic amplifier above the R area, and U.S. Pat. No. 4,781,537 suggests admitting a secondary gas or liquid into a hydrokinetic amplifier below the R area. The arrangement of the '335 patent is suggested for compressing a gas, and the arrangement of the '537 patent allows a hydrokinetic amplifier to produce a variable output flow, depending upon the downstream load or pressure resistance. My arrangement of a hydrokinetic amplifier departs from both of these suggestions, because it introduces a secondary vapor or gas downstream of the R area and does so in a way that does not vary the output flow as a function of downstream load or pressure resistance.

SUMMARY OF INVENTION

My arrangement of a hydrokinetic amplifier for boiler feed return in a Rankine cycle system uses two or more vapor inputs arranged to maximize both the pumping and warming capabilities of a hydrokinetic amplifier. It thus minimizes the mechanical work expended in pumping condensate return and eliminates heat exchangers for preheating the condensate.

I prefer that the condensate be pumped to a sufficient pressure for liquid input to a hydrokinetic amplifier so that the output pressure from the hydrokinetic amplifier is at least equal to boiler pressure. I input a primary pumping vapor from a relatively low pressure region of a turbine into the hydrokinetic amplifier to warm and accelerate a condensate stream to a high velocity through the R area of the hydrokinetic amplifier. Downstream of the R area, and upstream of a diffuser, I merge one or more heating vapors with the accelerated condensate stream to raise its temperature significantly. I draw the heating vapor from a higher pressure region of the turbine so that the vapor can heat the accelerated condensate stream while condensing into it, and I direct the heating vapor and condensate stream through a throat region and into a diffuser that converts fluid velocity to pressure. By setting proper parameters for the hydrokinetic amplifier and its inputs, the output pressure from the diffuser can exceed boiler pressure and preferably eliminate the need for any downstream condensate pump. Proper parameter setting can also preheat the condensate close to the boiling temperature at boiler pressure without requiring any downstream heat exchangers.

My arrangement preferably accelerates the warming vapor into the hydrokinetic amplifier to at least sonic velocity by making the heating vapor pressure at least about double the pressure within a merging region downstream of the R area. This makes the flow of the warming or heating vapor a function of its input pressure, independent of downstream load pressure resistance. This also ensures that an adequate flow rate of heating vapor enters the hydrokinetic amplifier under all operating conditions. From this comes improved operating efficiency and reduced capital investment for a Rankine cycle boiler feed system.

If each merging region is properly configured to optimize liquid acceleration and potential pressure increases, then each merging region becomes a stage in a multi-stage hydrokinetic amplifier. This can be done by making each throat or R area suitably small for the flow conditions of the merging liquid and vapor approaching that R area or throat. It also preferably requires a start-up overflow to evacuate liquid from each merging region, as flow is established during start-up. A multi-stage hydrokinetic amplifier arranged with a succession of merging regions leading to a single diffuser output is much more efficient than a series of hydrokinetic amplifiers each having an output diffuser.

DRAWINGS

DETAILED DESCRIPTION

Figure 1:
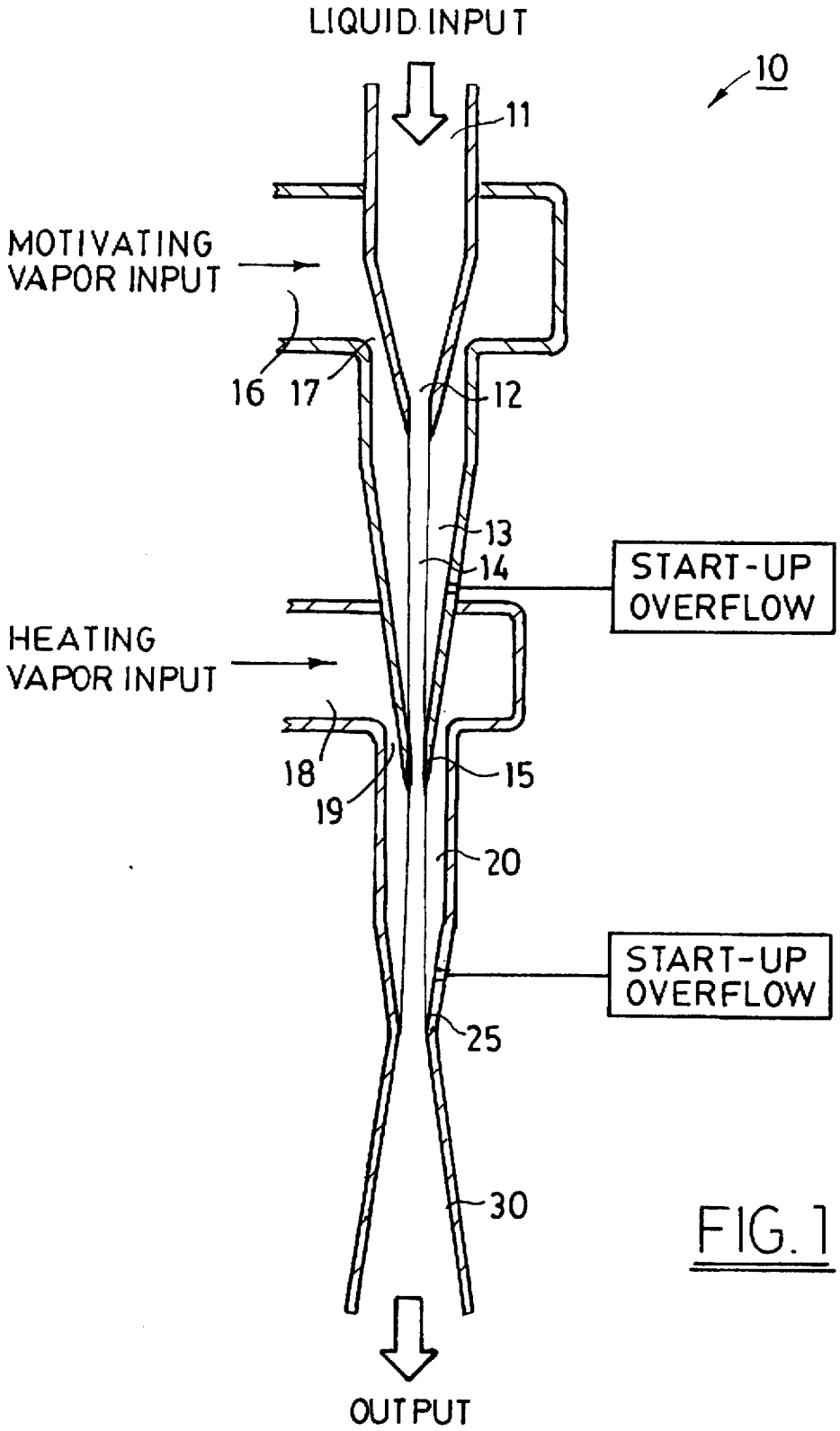
FIG. 1 is a schematic view of a hydrokinetic amplifier arranged to operate in a condensate return circuit of a Rankine cycle system according to my invention.

A form of hydrokinetic amplifier 10 that I prefer to use for boiler feed return is shown schematically in FIG. 1. It has a liquid input 11 into which a condensate is pumped so that liquid nozzle 12 directs a condensate stream 14 into a mixing chamber 13. The condensate stream proceeds through mixing chamber 13 without touching the walls of chamber 13 until it reaches an R area or minimum cross-sectional area 15.

A motivating vapor enters an input 16 and passes through a vapor nozzle 17 that surrounds the condensate stream from nozzle 12. Motivating vapor is accelerated by nozzle 17 into high velocity merger with condensate stream 14 so that the motivating vapor imparts kinetic energy to the condensate stream and accelerates the condensate stream toward R area 15. As the motivating or pumping vapor accelerates the condensate stream 14, it also condenses in the condensate and adds to the liquid volume or mass. This increases the flow rate of liquid leaving mixing chamber 13, compared with the flow rate of liquid entering mixing chamber 13; but the liquid acceleration that occurs in mixing chamber 13 allows R area 15 to be smaller in cross-sectional area than liquid input nozzle 12.

For most uses of hydrokinetic amplifiers, a diffuser is arranged directly downstream of R area 15 to convert the liquid velocity through R area 15 into liquid pressure. Losses occur as a diffuser does this, and typical diffusers used in hydrokinetic amplifiers are about 75 percent efficient in converting velocity to pressure. Partly for this reason, I prefer that a single hydrokinetic amplifier, with a single diffuser, accomplish the necessary boiler feed return. An array of similar hydrokinetic amplifiers can be operated in parallel to receive similar inputs and multiply the flow rate of the output.

I also prefer that the output pressure from a hydrokinetic amplifier be sufficiently high for returning condensate to a boiler without requiring any downstream condensate pump. This requires that the inflow of condensate liquid and motivating vapor be sufficiently energetic so that the output pressure can exceed boiler pressure. This also requires an upstream condensate pump, pressurizing condensate to considerably less than boiler pressure, since the hydrokinetic amplifier itself substantially increases liquid pressure.

Rankine cycle system efficiency requires that condensate be preheated before returning to the boiler. Ideally, condensate is heated to the boiling point temperature at boiler pressure so that a boiler adds only latent heat of vaporization; but because of trade-offs involving other parameters, the ideal is not obtained.

The way I accomplish the desired preheating of the condensate stream is to introduce a warming or heating vapor through an input 18 to be accelerated through a nozzle 19 into a merging area or chamber 20 downstream of R area 15. This differs from the arrangement shown in U.S. Pat. No. 4,781,537 in that merging region 20 is enlarged to allow ample room for a heating vapor to expand, and nozzle 19 diverges to accelerate the incoming vapor as much as possible. By the preferred way of accomplishing this, as explained below, merging chamber 20 becomes a second stage in a multi-stage hydrokinetic amplifier and, as such, produces liquid acceleration as well as vapor condensation.

The condensate stream leaving R area 15 has been warmed by condensation of the pumping vapor so that condensing more vapor into the condensate stream requires higher pressure and temperature for the heating vapor. It is also desirable that the heating vapor expand sufficiently into merging chamber 20 so that it reaches at least sonic velocity in passing through nozzle 19. These objectives lead to a heating vapor drawn from a higher pressure and temperature region of a Rankine cycle system so that the heating vapor is at least about double the vapor pressure in merging region 20. The pressure required for sonic velocity varies with different vapors and gases and with the saturation of the vapors so that the "about double" requirement is an approximation. With typical vapors involved in Rankine cycle systems, pressure requirements for sonic velocity of an incoming vapor range from about 1.7 to about 1.9 times the pressure in merging region 20. The "about double" requirement refers to the minimum pressure to achieve sonic velocity, which can range from somewhat less than double the downstream pressure to considerably more than double the downstream pressure.

In a Rankine cycle system, these needs can be satisfied by drawing a heating vapor from a higher pressure region of a turbine so that its pressure at heating vapor inlet 18 is adequate for sonic velocity, which is desirable but not essential. Such a higher pressure heating vapor is also able to condense in the condensate stream passing through merging chamber 20. All of the heating vapor need not condense within the merging chamber 20, however, because any uncondensed heating vapor can pass with condensate stream 14 through a throat 25 and into a diffuser 30, which converts fluid velocity to pressure. Some vapor passing through throat 25 and into diffuser 30 along with the liquid condensate stream apparently increases diffuser efficiency. Observations have shown diffuser efficiencies as high as 85 percent when vapor enters the diffuser along with the liquid stream. As liquid pressure increases along the expanding length of diffuser 30, vapor present in the flow condenses. Even if this were not to occur, though, the output pressure from diffuser 30 is preferably at least as high as boiler pressure so that the outflow is efficiently directed to the boiler, even if it were to include some uncondensed vapor.

Sonic or supersonic flow of heating vapor into merging region 20, combined with throat 25 and diffuser 30 arranged downstream of merging region 20, makes the inflow rate of heating vapor independent of the downstream fluid pressure or load resistance. The rate of inflow of heating vapor through input 18 is then a function of the pressure of the heating vapor, rather than downstream load conditions. More specifically, the inflow rate for heating vapor is a function of the amount by which the vapor pressure exceeds the pressure needed for sonic velocity inflow. This also departs from the suggestion of U.S. Pat. No. 4,781,537 that an inflow beyond the R area be variable in response to downstream pressure changes.

R area 15 is generally made as small as possible to maintain the condensate liquid at the highest practical velocity. High velocity liquid flow is also aided by maximizing acceleration of vapor into merging region 20. A small R area 15 and high velocity vapor working to accelerate the condensate stream can make merging region 20 serve as a second stage of hydrokinetic amplifier 10, providing that a start-up overflow is positioned above throat or minimum cross-sectional area 25. This can be similar to a start-up overflow positioned above R area 15. In effect, hydrokinetic amplifier 10 can have a succession of R areas 15 and 25, with acceleration of the condensate stream occurring in each merging region 13 and 20 and with vapor condensation and increasing temperature occurring from each merger.

Depending on the flow rate of heating vapor through input 18, the area of throat 25 can range from slightly larger than R area 15 down to slightly smaller than R area 15. The conditions of the incoming vapor and the vapor pressure in chamber 20 will affect flow rates, vapor condensation, and the proper sizing of throat 25, which in effect becomes a second R area for hydrokinetic amplifier 10.

If a succession of vapors are available at sufficiently high pressures, amplifier stages for hydrokinetic amplifier 10 can be multiplied to three or more stages in succession. If the inflow rates and parameters of each merging region and each R area are properly established for accelerating vapor into merger with a condensate stream, then the condensate stream can be accelerated in each successive merging region so that its velocity increases through each successive R area. Fluid flow rate also increases with each merger, because of the vapor that is added and condensed at each stage; and the temperature of the condensate also increases with each stage. The final stage outputs to a single diffuser that converts kinetic flow energy into pressure. The final stage can also intake more vapor than can be condensed upstream of the diffuser, because the increasing pressure in the diffuser will complete the vapor condensation.

Such a multi-stage hydrokinetic amplifier is not only more efficient than a plurality of hydrokinetic amplifiers in series, but also accommodates existing Rankine cycle systems that are designed to divert several different portions of turbine vapor to heat exchanger use. Instead of extracting heat from such vapors in heat exchangers, the vapors can be applied to the successive stages of a multi-stage hydrokinetic amplifier, as explained below relative to FIG. 3.

There is no known limitation on the type of Rankine cycle system for which condensate can be returned to a boiler with a hydrokinetic amplifier arranged according to my invention. In other words, the Rankine cycle system need not be limited to use of steam and water and can use other vapors and condensates, including ammonia vapor and ammonia and several other materials that have been suggested. Rankine cycle systems using vapors and liquids of ammonia and water are presently operational, and hydrokinetic amplifier 10 is known to work effectively with water and ammonia vapor.

Figure 2:
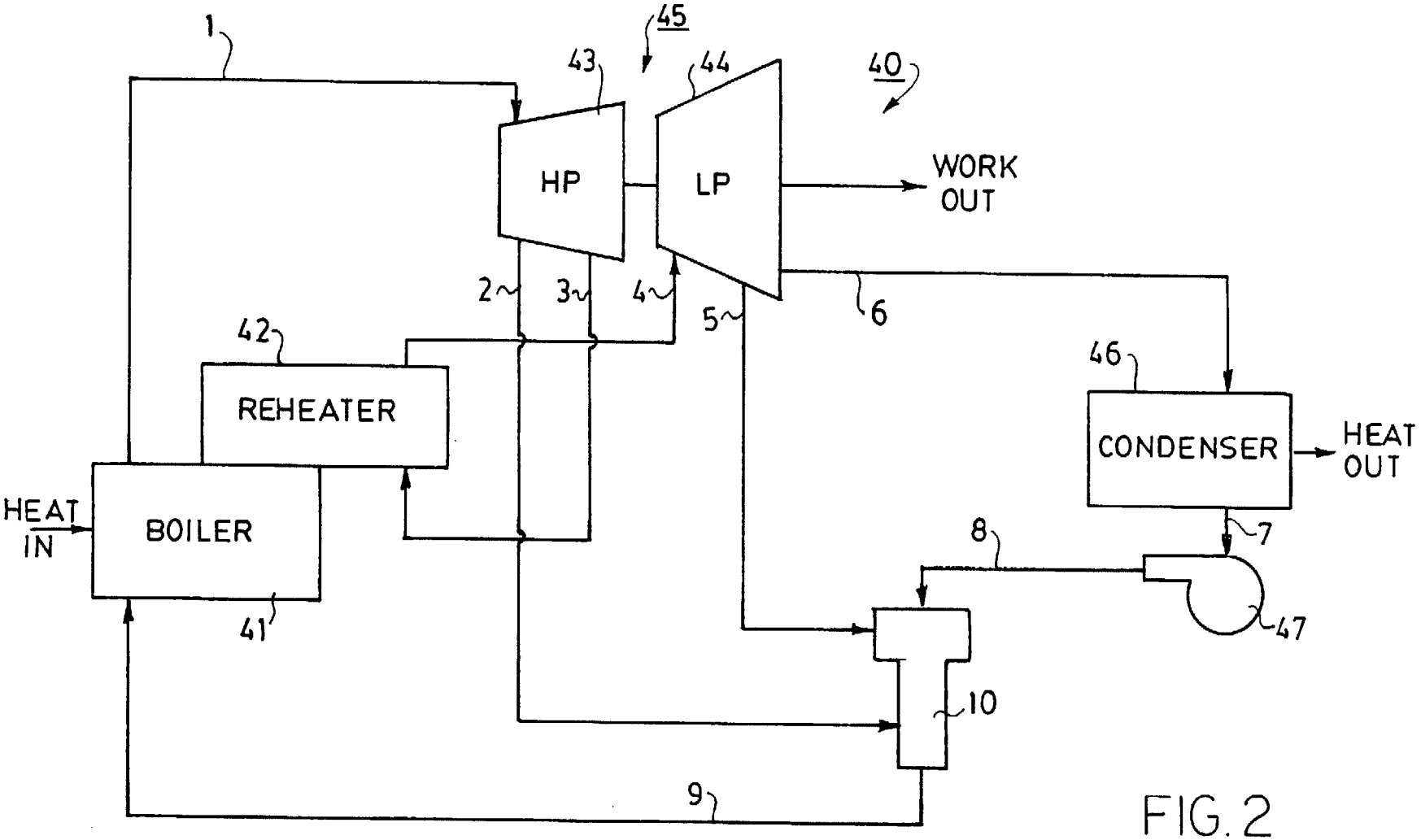
FIG. 2 is a schematic diagram of a Rankine cycle system using a hydrokinetic amplifier arranged according to my invention for boiler feed return.

The following example shows how a hydrokinetic amplifier 10 can be arranged according to my invention for returning condensate to a boiler in a Rankine cycle system involving steam and water only, although the invention is not limited to these materials. The example of the Rankine cycle circuit is schematically illustrated in FIG. 2, and a listing of values at indicated lines in the circuit appear in Table 1. These are approximations that have not been optimized. They show in principle how a hydrokinetic amplifier can return boiler feed in a Rankine cycle system; but they do not represent actual values from an optimized system, which might differ somewhat from the calculated and assumed values.

The main components of Rankine cycle system 40, which have been simplified and made schematic for ease and clarity of illustration, include boiler 41, reheater 42, turbine 45 having a high pressure section 43 and a low pressure section 44, condenser 46, condensate pump 47, and hydrokinetic amplifier 10 in a form such as schematically illustrated in FIG. 1. Points taken at lines in system 40, numbered 1 through 10, have pressures, temperatures, and enthalpies, as set out in Table 1. These values indicate the hypothetical condition of steam or water in an identified line, with the number 10 identifying the interior of hydrokinetic amplifier 10 at its R area. The numbers also assume a circulation of one pound of steam or water, with indicated portions of a pound flowing in some of the lines.

TABLE 1

| LINES | TEMPERATURE (°F.) | PRESSURE (psia) | ENTHALPY h (BTU/lb. °F.) | FLOW RATE (lb.) |
|---|---|---|---|---|
| 1 | 1000.0 | 2400.0 | 1460.400 | 1.00 |
| 2 | 783.2 | 1100.0 | 1372.400 | 0.20 |
| 3 | 636.0 | 600.0 | 1311.800 | 0.80 |
| 4 | 1000.0 | 600.0 | 1517.800 | 0.80 |
| 5 | 766.2 | 240.0 | 1406.000 | 0.16 |
| 6 | 79.6 | 0.5 | 997.530 | 0.64 |
| 7 | 79.6 | 0.5 | 47.619 | 0.64 |
| 8 | 80.0 | 500.0 | 49.866 | 0.64 |
| 9 | 538.0 | 2400.0 | 531.354 | 1.00 |
| 10 | 348.0 | | 321.093 | |

At boiler 41, heat input $Q_1$ equals 929.0457 BTU added to generate a pound of superheated steam. Additional heat, $Q_2$ equaling 164.8 BTU, is added at reheater 42. $Q_1+Q_2$ equals 1093.8457 BTU. Heat $Q_3$ is rejected at condenser 46 in the amount of 607.943 BTU. Turbine 45 is assumed to operate at 86 percent efficiency, and work outputs are expressed as changes in enthalpy h, or Δh. These include the following:

| WORK OUTPUT | Δh |
|---|---|
| Heating vapor to hydrokinetic amplifier 10 via line 2 | 17.6000 |
| Vapor to reheater 42 via line 3 | 118.8800 |
| Pumping vapor to hydrokinetic amplifier 10 via line 5 | 17.8880 |
| Turbine exhaust to condenser via line 6 | 332.9728 |
| TOTAL Turbine work output | 487.3408 |

Theoretically, the work output from turbine 45, minus the work required at condensate pump 47 (1.438 BTU/lb.), yields a net work output of 485.902 Δh. This, divided by the total heat input of 1093.8457 BTU, yields a cycle efficiency of 0.4442, or 44.42 percent. This calculation ignores minor losses in piping, as is traditional in evaluating Rankine cycle systems. It is also based on estimates, as explained above.

Expressed in words, a pound of steam leaving boiler 41 in line 1 is at a pressure of 2400 psia and a temperature of 1000° F., which gives the steam an enthalpy of 1460.4. Part of this enthalpy produces work in high pressure turbine section 43, and a portion (Δh=17.6) is directed to the heating vapor input of hydrokinetic amplifier 10 for preheating boiler feed return. Another portion (Δh=118.88) is diverted through line 3 to reheater 42 where additional heat ($Q_2$=164.8) is added. This gives the steam in line 4 a pressure of 600 psia, a temperature of 1000° F., and an enthalpy of 1517.8. More work is extracted from this steam in the low pressure section 44 of turbine 45 to produce the total work output of Δh=487.3408. A portion of this (1.438 BTU) is expended in driving condensate pump 47 and is thus subtracted to give a net work output of Δh=485.902. After the latent heat of vaporization ($Q_3$=607.943) is rejected at condenser 46, the resulting condensate liquid in line 7 has a pressure of 0.5 psia, a temperature of 79.6° F., and an enthalpy of 47.619.

The condensate pump 47 pumps the condensate up 499.5 psi and is assumed to work at 66 percent efficiency. This gives the condensate in line 8 a pressure of 500 psia, a temperature of 80° F., and an enthalpy of 49.866. This condensate enters hydrokinetic amplifier 10 where it forms a condensate stream as previously explained that is accelerated by pumping vapor from line 5. The pumping vapor condenses in the condensate stream and accelerates it through the R area of hydrokinetic amplifier 10 where the temperature of the condensate rises to 348° F., and the enthalpy rises to 321.093. The velocity of the condensate through the R area is calculated to be 635 feet per second, which is fast enough so that when converted to pressure in a diffuser, the pressure will exceed the 2400 psia pressure of boiler 41.

For preheating the accelerated condensate stream in hydrokinetic amplifier 10, a heating vapor is delivered through line 2 to merge with the condensate downstream of the R area as previously described. The output condensate from hydrokinetic amplifier 10 flowing in line 9 has a pressure of at least 2400 psia and an enthalpy of 531.354. Calculations show this pressure can be as high as 3000 psia, but the actual pressure will be responsive to downstream resistance so that the boiler pressure of 2400 psia is selected to approximate the actual pressure expected in line 9.

The temperature of the condensate return in line 9 is 538° F., which is within 124° of the boiling point temperature of 662° F. for water under 2400 psia pressure in boiler 41. A high temperature for condensate return is desirable in Rankine cycle systems so that the boiler adds relatively little sensible heat to the condensate. Approaching this close to the boiling point temperature of boiler 41 improves considerably over what is accomplished in typical Rankine cycle systems using heat exchangers to preheat boiler feed return.

Figure 3:
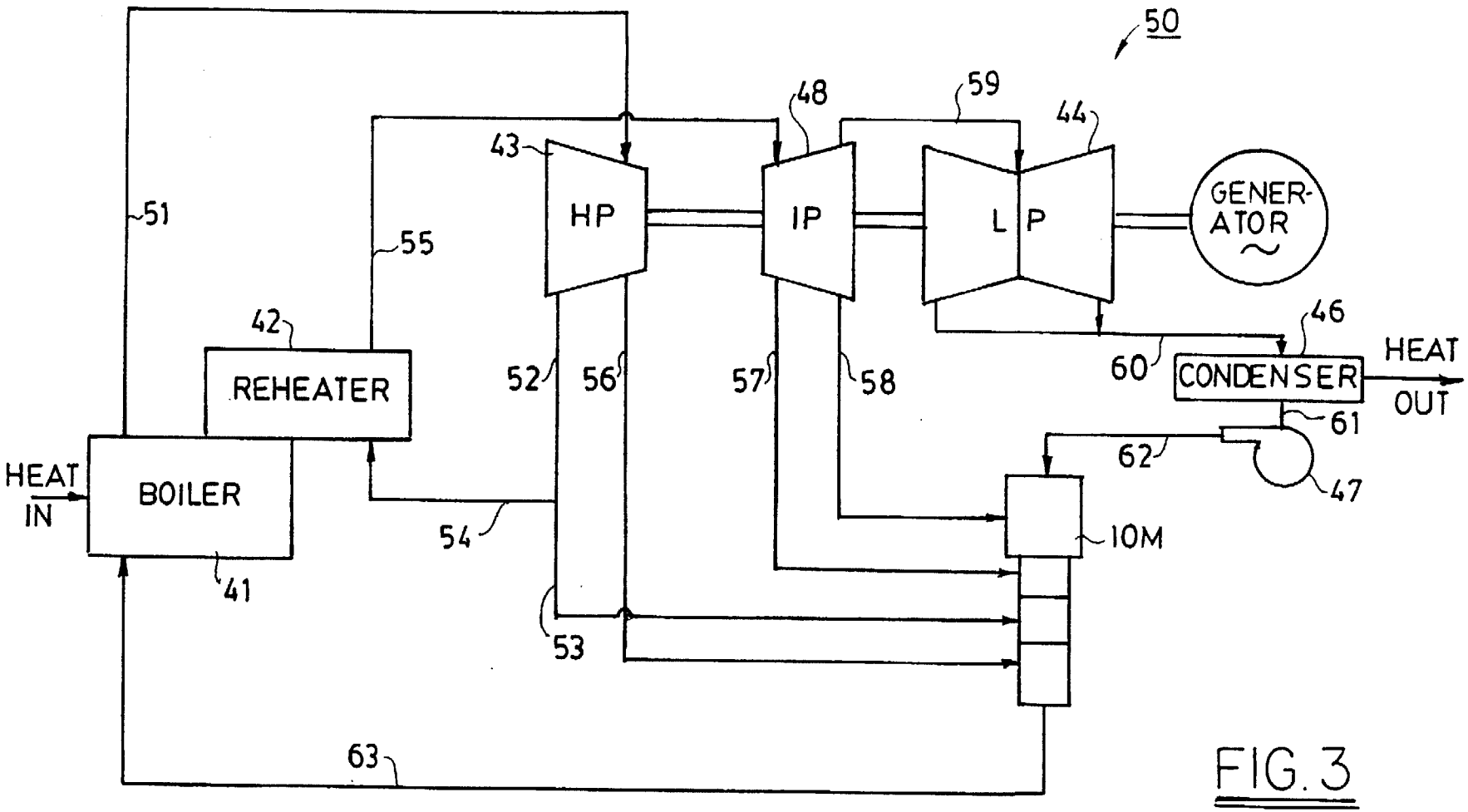
FIG. 3 is a schematic diagram of another Rankine cycle system using a multi-stage hydrokinetic amplifier arranged according to my invention for boiler feed return.

The Rankine cycle system 50, schematically shown in FIG. 3, is designed for tapping vapor from several points on a more complex turbine that includes an intermediate pressure section 48, in addition to a high pressure section 43 and a low pressure section 44. A multi-stage hydrokinetic amplifier 10M accommodates system 50 by accepting vapors at successively higher pressures for each of four amplifier stages in series. The operation of a multi-stage hydrokinetic amplifier, as explained above, accelerates and increases the temperature of a condensate stream in each stage, as the stream proceeds successively through each R area until it reaches an output diffuser.

Assumed and approximate values for a 100 pound per second flow of steam and water in system 50 produce the values shown in Table 2 for flow in the lines as numbered in FIG. 3.

TABLE 2

| LINES | TEMPERATURE (°F.) | PRESSURE (psia) | ENTHALPY h (BTU/lb. °F.) | FLOW RATE (lb./sec.) |
|---|---|---|---|---|
| 51 | 1000.0 | 2400.0 | 1460.000 | 100.00 |
| 53 | 500.0 | 350.0 | 1251.500 | 8.50 |
| 55 | 1000.0 | 320.0 | 1526.500 | 82.50 |
| 56 | 800.0 | 1000.0 | 1389.200 | 9.00 |
| 57 | 800.0 | 120.0 | 1428.100 | 8.50 |
| 58 | 600.0 | 50.0 | 1332.800 | 7.00 |
| 59 | 600.0 | 50.0 | 1332.800 | 67.00 |
| 60 | 80.0 | 0.5 | 1040.000 | 67.00 |
| 61 | 80.0 | 0.5 | 48.000 | 67.00 |
| 62 | 81.0 | 500.0 | 50.100 | 67.00 |
| 63 | 492.0 | 2500.0 | 479.657 | 100.00 |

Boiler 41 of the example of FIG. 3 produces 100 pounds per second of steam at 2400 psia and a temperature of 1000° F., having an enthalpy of 1460, directed to high pressure turbine section 43. Some of the steam is tapped from turbine section 43 via line 56 for the final preheating stage of hydrokinetic amplifier 10M, which uses 9 pounds of steam per second at 1000 psia and 800° F., having an enthalpy of 1389.2. Steam output from turbine section 43 is directed to reheater 42; and 8.5 pounds per second of this steam, at 350 psia and 500° F., having an enthalpy of 1251.5, is directed via line 53 to the penultimate preheater stage of amplifier 10M. The remaining 82.5 pounds of steam is raised to 1000° F. by reheater 42 and is directed at a pressure of 320 psia and an enthalpy of 1526.5 to intermediate turbine section 48. A tap from this turbine section diverts 8.5 pounds of steam through line 57 at 120 psia and 800° F., with an enthalpy of 1428.1, to the first preheater stage of hydrokinetic amplifier 10M. A final tap from turbine section 48 directs 7 pounds of steam via line 58 at 50 psia and 600° F., having an enthalpy of 1332.8, to the primary vapor inlet of hydrokinetic amplifier 10M. The successive stages of hydrokinetic amplifier 10M are thus provided with vapors of successively higher pressures so that each vapor can accelerate and condense in a condensate stream passing successively through the amplifier stages. This maximizes both the pumping and heating ability of hydrokinetic amplifier 10M.

Of the steam exhausted from intermediate turbine section 48, 67 pounds per second is directed to low pressure turbine section 44 via line 59 with a temperature of 600° F. and an enthalpy of 1332.8. After expansion in low pressure turbine section 44, this steam has an enthalpy of 1040, a pressure of 0.5 psia, and a temperature of 80° F., as it proceeds through line 60 to condenser 46. After rejection of its latent heat at condenser 46, the condensate stream proceeding to condensate pump 47 via line 61 has an enthalpy of 48, a pressure of 0.5 psia, and a temperature of 80° F. Pump 47 increases the condensate pressure to 500 psia, raises the temperature to 81° F., and raises the enthalpy to 50.1. At hydrokinetic amplifier 10M, the 67 pounds of condensate is merged successively with vapors as previously explained, which recombines flows to produce the 100 pounds per second output in line 63, returning condensate to boiler 41. The pressure in line 63 is 2500 psia, and the temperature of the returning condensate is 492° F., with an enthalpy of 479.657.

The examples of FIGS. 2 and 3 are only two of a multitude of Rankine cycle systems that can use hydrokinetic amplifiers for boiler feed return according to my invention. The values for these examples are also assumed and estimated to determine feasibility, and actual performance of a hydrokinetic amplifier in a real boiler feed return system might vary somewhat from the performance indicated. The numbers are believed to be conservative, however, so that actual performance might improve on the assumptions made in assigning values to the examples of FIGS. 2 and 3.

Multi-stage hydrokinetic amplifiers, such as preferred for boiler feed return, may also have other uses. Wherever vapors of different pressures and conditions are available, they can be introduced into successive stages of a multi-stage hydrokinetic amplifier for maximizing pressure and temperature of the output. Vapors, gases, and liquids other than steam and water can also be used in multi-stage hydrokinetic amplifiers, which can output mixtures of liquids or liquids and gases. Such varied uses are also not limited to Rankine cycle systems or boiler feed return. When used for boiler feed return in Rankine cycle systems, though, multi-stage hydrokinetic amplifiers can reduce mechanical pump work and eliminate the need for heat exchangers, to considerably reduce capital expense and maintenance, since a hydrokinetic amplifier is a compact and relatively inexpensive device having no moving parts.

I claim:

1. A Rankine cycle system including a boiler, a turbine, a condenser, and a hydrokinetic amplifier, said system comprising:

a. a condensate pump for pumping condensate into a liquid input of the hydrokinetic amplifier;

b. a motivating vapor line directing vapor from the turbine to a motivating vapor input nozzle of the hydrokinetic amplifier;

c. a heating vapor line drawn from a higher pressure region of the turbine than the motivating vapor for directing the heating vapor into merger with an accelerated stream of condensate in a merging region of the hydrokinetic amplifier downstream of an R area;

d. a throat region of the hydrokinetic amplifier arranged for receiving the heating vapor and condensate from the merging region; and e. a diffuser downstream of the throat region for converting fluid velocity to pressure directed to the boiler.

2. The system of claim 1 including a heating vapor nozzle configured for expanding the heating vapor supersonically into the merging region.

3. The system of claim 1 configured so that the output from the diffuser has a pressure at least as high as the pressure of the boiler.

4. The system of claim 1 wherein the heating vapor substantially condenses in the condensate before the condensate leaves the diffuser.

5. The system of claim 1 configured so that the heating vapor pressure is at least about double the pressure in the merging region resulting in the heating vapor entering the merging region at at least sonic velocity.

6. The system of claim 1 configured so that the inflow rate of the heating vapor is independent of fluid flow resistance pressure downstream of the diffuser.

7. The system of claim 1 including a plurality of heating vapor lines for drawing heating vapors from successively higher pressure regions of the turbine, each of the heating vapors being directed in succession into merger with the accelerated condensate stream in a succession of merging regions in the hydrokinetic amplifier.

8. A Rankine cycle boiler feed system using a hydrokinetic amplifier and comprising:

a. condensate drawn from the Rankine cycle and pumped into the hydrokinetic amplifier;

b. a motivating vapor drawn from the Rankine cycle and directed into the hydrokinetic amplifier for condensing in the condensate, warming the condensate, and accelerating the condensate to a high velocity through an R area;

c. a warming vapor drawn from the Rankine cycle and directed to merge with the accelerated condensate as it departs from the R area;

d. the warming vapor having sufficient pressure for condensing in and substantially raising the temperature of the accelerated condensate; and e. the accelerated condensate and warming vapor being directed through a throat and into a diffuser that converts fluid velocity to pressure directed to a boiler.

9. The system of claim 8 wherein the pressure of the warming vapor is substantially higher than the pressure of the motivating vapor.

10. The system of claim 9 configured so that the pressure of the warming vapor is at least about double the pressure in a region where the warming vapor and condensate merge downstream of the R area.

11. The system of claim 8 configured so that the warming vapor is directed supersonically into merger with the accelerated condensate.

12. The system of claim 8 configured so that the output pressure from the hydrokinetic amplifier is at least boiler pressure.

13. The system of claim 8 configured so that the warming vapor flows into the hydrokinetic amplifier at a rate that is independent of fluid flow resistance pressure downstream of the diffuser.

14. The system of claim 8 wherein a plurality of motivating vapors derived from different regions of the Rankine cycle and having successively higher pressures are directed into the hydrokinetic amplifier for successively warming and accelerating the condensate stream.

15. A hydrokinetic amplifying system having inputs receiving from available sources a condensate in a central jet and a motivating vapor that surrounds and mixes together with the condensate to condense the vapor and warm and accelerate the condensate through an R area to a high velocity, the system comprising:

a. a secondary gas flowing from another source into merger with the accelerated condensate through a converging and diverging nozzle surrounding the accelerated condensate downstream of the R area;

b. a minimum pressure of the secondary gas being at least about double the vapor pressure of the accelerated condensate so that the secondary gas accelerates into merger with the condensate at at least sonic velocity; and c. an inflow rate of the secondary gas into merger with the accelerated condensate being a function of the amount by which the pressure of the secondary gas exceeds the minimum pressure.

16. The system of claim 15 wherein the secondary gas is a vapor that condenses in the accelerated condensate.

17. The system of claim 16 configured so that the secondary vapor has sufficient pressure to raise the temperature of the accelerated condensate.

18. The system of claim 16 wherein the sources of the condensate, the motivating vapor, and the secondary vapor are located within a Rankine cycle system.

19. The system of claim 18 wherein the secondary vapor has a higher pressure than the motivating vapor.

20. The system of claim 15 wherein a throat region and a diffuser receive the merged secondary gas and condensate, and the diffuser converts fluid velocity to pressure.

21. The system of claim 20 wherein the sources of the condensate, the motivating vapor, and the secondary vapor are located within a Rankine cycle system; and the output pressure from the diffuser is at least boiler pressure.

22. The system of claim 20 configured so that the inflow rate of the secondary gas is independent of fluid flow resistance pressure downstream of the diffuser.

23. A method of returning condensate to a boiler in a Rankine cycle system, the method comprising:

a. pumping the condensate into an input of a hydrokinetic amplifier to form a condensate stream within the hydrokinetic amplifier;

b. surrounding the condensate stream with a pumping vapor that combines with the condensate stream to condense the pumping vapor and accelerate the condensate stream to a high velocity through an R area;

c. surrounding the accelerated condensate stream with a sufficiently pressurized heating vapor in a merging region downstream of the R area so that the heating vapor condenses in and warms the accelerated condensate stream; and d. directing the merged heating vapor and accelerated condensate stream through a throat region into a diffuser to convert fluid velocity to pressure directed to the boiler.

24. The method of claim 23 including drawing the heating vapor from a higher pressure region than the pumping vapor.

25. The method of claim 23 including drawing the heating vapor from a region of the Rankine cycle system having a pressure at least about double the pressure in the merging region and accelerating the heating vapor to at least sonic velocity upon entering the merging region.

26. The method of claim 25 wherein an inflow rate for the heating vapor is a function of the amount by which heating vapor pressure exceeds a pressure needed for the heating vapor to enter the merging region at sonic velocity.

27. The method of claim 23 wherein an output pressure from the diffuser is at least equal to a pressure of the boiler.

28. The method of claim 23 wherein an inflow rate for the heating vapor is independent of fluid flow resistance downstream of the diffuser.

29. The method of claim 23 including successively merging a plurality of heating vapors with the condensate stream in a succession of merging regions so that each heating vapor has a higher pressure than its predecessor and each heating vapor warms and accelerates the condensate stream.

30. A method of merging a gas with an accelerated condensate stream in a hydrokinetic amplifier merging chamber arranged directly downstream of an R area, the method comprising:

a. directing the merging gas through an expanding nozzle into the merging chamber;

b. providing the merging gas with an input pressure at least about double a pressure in the merging chamber so that the merging gas expands at least sonically through the nozzle into engagement with the accelerated condensate stream;

c. directing the merging gas and accelerated condensate stream into a throat region downstream of the merging chamber and then into a diffuser of the hydrokinetic amplifier that converts fluid velocity to pressure; and d. an input flow rate of the merging gas being a function of an amount by which the pressure of the merging gas exceeds a pressure needed for the merging gas to enter the merging chamber at sonic velocity and being independent of fluid flow resistance pressure downstream of the diffuser.

31. The method of claim 30 wherein the merging gas comprises a vapor condensable in the accelerated condensate stream.

32. The method of claim 30 wherein the condensate stream is derived from a Rankine cycle system and an output from the hydrokinetic amplifier is directed to a boiler of the Rankine cycle system.

33. The method of claim 32 wherein the output has a pressure at least as high as the boiler.

34. The method of claim 32 wherein the merging gas is a vapor derived from the Rankine cycle system at a pressure sufficient to warm the accelerated condensate stream for preheating boiler feed return.

35. A hydrokinetic amplifier comprising:

a. a plurality of merging regions arranged in succession so that a vapor surrounds, merges with, condenses in, and accelerates a liquid stream passing successively through each of the merging regions;

b. the merging regions each having a start-up overflow;

c. the merging regions being separated from each other by an R area and not being separated from each other by a diffuser: and d. liquid acceleration occurring in each of the merging regions.

36. The hydrokinetic amplifier of claim 35 wherein a single diffuser is arranged downstream of a final merging region.

37. The hydrokinetic amplifier of claim 35 configured to receive vapor at successively increasing pressures at each of the successive merging regions.

38. The hydrokinetic amplifier of claim 35 configured so that the velocity of the liquid stream increases in each of the successive merging regions.

39. The hydrokinetic amplifier of claim 35 configured to receive vapor entering each successive merging region at at least sonic velocity.

40. A multi-stage hydrokinetic amplifier comprising:

a. a succession of merging regions each having a vapor inlet arranged for merging a surrounding vapor with a liquid stream passing successively through the merging regions;

b. an R area with no diffuser between each of the succession of merging regions:

c. each of the merging regions having a start-up overflow;

d. vapor merger with liquid in each of the merging regions resulting in liquid acceleration; and e. a diffuser receiving the liquid output from the final merging region to convert fluid velocity to pressure.

41. The hydrokinetic amplifier of claim 40 configured to accelerate incoming vapor in each of the vapor inlets to at least sonic velocity.

42. The hydrokinetic amplifier of claim 40 configured so that liquid velocity increases in each successive one of the merging regions.

43. The hydrokinetic amplifier of claim 40 wherein vapor condenses in the liquid stream in each successive one of the merging regions.

44. The hydrokinetic amplifier of claim 40 configured to receive a successively higher pressure vapor at each successive one of the vapor inlets.

* * * * *